US007556175B2

(12) United States Patent
Simkins

(10) Patent No.: US 7,556,175 B2
(45) Date of Patent: Jul. 7, 2009

(54) TOWELETTE DISPENSER

(75) Inventor: Nelson E. Simkins, Rittman, OH (US)

(73) Assignee: Joseph S. Kanfer, Richfield, OH (US)

( * ) Notice: Subject to any disclaimer, the term of this patent is extended or adjusted under 35 U.S.C. 154(b) by 250 days.

(21) Appl. No.: 11/363,822

(22) Filed: Feb. 28, 2006

(65) Prior Publication Data

US 2007/0199949 A1 Aug. 30, 2007

(51) Int. Cl.
*B65H 1/00* (2006.01)
*A47K 10/24* (2006.01)
*B65D 85/00* (2006.01)

(52) U.S. Cl. ..... 221/63; 221/45; 221/46; 206/409

(58) Field of Classification Search ..... 221/63, 221/303, 33, 45, 46, 267; 206/209, 494, 206/207, 233, 812, 409; 219/386
See application file for complete search history.

(56) References Cited

U.S. PATENT DOCUMENTS 3,982,659 A * 9/1976 Ross ..... 221/63
5,370,338 A * 12/1994 Lewis ..... 242/593
5,857,642 A * 1/1999 Zinnbauer ..... 242/590
6,328,252 B1 * 12/2001 Neveu et al. ..... 242/593
6,331,696 B1 * 12/2001 Nakamura et al. ..... 219/386
6,499,626 B1 * 12/2002 Julius ..... 221/63
6,604,628 B1 * 8/2003 Tanaka et al. ..... 206/209
7,216,775 B2 * 5/2007 Evans et al. ..... 221/63
2002/0074375 A1 * 6/2002 Irwin ..... 225/6
2003/0221986 A1 * 12/2003 Reinke et al. ..... 206/494
2005/0092765 A1 * 5/2005 Chasid et al. ..... 221/63
2005/0279756 A1 * 12/2005 Bitowft et al. ..... 221/45

* cited by examiner

*Primary Examiner*—Gene Crawford
*Assistant Examiner*—Rakesh Kumar
(74) *Attorney, Agent, or Firm*—Renner, Kenner, Greive, Bobak, Taylor & Weber

(57) ABSTRACT

A towelette dispenser is provided with an integrally molded lid. The lid has a central aperture for allowing access to a roll of towelettes maintained within a tub receiving the lid therein. The separation bar bridges the aperture, and provides a rip fence in the form of a fingered thimble that is angled with respect to the lid as a whole. The thimble is offset near one edge of the annular opening so that a user may make access to the back side thereof to thread an edge of the leading towelette through the thimble without having to remove the lid from the tub. A well is provided in the smaller portion of the aperture and a cap for the lid is provided with a stuffer tab to urge the leading edge of the next towelette into the well when the cap is closed.

15 Claims, 1 Drawing Sheet

TOWELETTE DISPENSER

TECHNICAL FIELD

The invention herein resides in the art of dispensing devices and, more particularly, to devices adapted for maintaining and allowing for the separate dispensing of interconnected towelettes or "wipes." Specifically, the invention relates to a novel integrally configured dispensing lid and cap that allows for ease of threading the leading towelette into the separating mechanism, while accommodating secured closure of the cap upon the towelette container.

BACKGROUND ART

It has become increasingly popular to employ towelettes or "wipes" in various industries and in everyday life. Typically, a towelette or wipe is a fibrous piece of material that is impregnated or saturated with a cleanser or treatment, such as disinfectant, detergent, solvent, wax or polish, by way of example only.

While such towelettes have previously been maintained in containers in a fan fold arrangement, where the towelettes are separate and independent of each other, the most common and utilitarian type presently employed finds the towelettes forming a continuous web and being separable from each other by means of perforations or the like. Typically, the towelettes are maintained upon a continuous roll, although the invention contemplates random mass storage and maintenance of the same. In such arrangements, the tub or container maintaining the towelettes has generally been provided with a lid having a rip fence or other separating mechanism to allow for the separation of the leading towelette from the remaining towelettes on the roll or within the grouping. Several problems have characterized the prior art devices. Most formidable is the mechanism by which the leading edge of the first towelette is threaded into the rip fence, such that the remainder of the web may be progressively pulled therethrough and the towelettes individually separated. Prior devices have typically required removal of the lid from the tub or container of towelettes, the threading of the leading towelette through the rip fence, and the replacement of the lid upon the tub. Such a process has typically been found to be complex and given to error and frustration by the user. Moreover, the prior art towelette dispensers have not been given to a simplicity in design that provides a mechanism that ensures that the leading edge of the next towelette to be dispensed is stuffed within the container or tub and not in the way of the lid or cap when it is to be closed and sealed.

The prior art dispensers have also had dispensing lids that are complex and costly, often being of multiple pieces requiring seam welding and the like to configure the pieces into an operative unit.

There remains a need in the art for a simple, cost effective, and reliable lid for a towelette dispenser that allows for ease of use and ease of set-up.

DISCLOSURE OF THE INVENTION

In light of the foregoing, it is a first aspect of the invention to provide a towelette dispenser that has a lid that is of a totally integral design.

Another aspect of the invention is the provision of a towelette dispenser having a lid that accommodates ease of threading of the leading edge of the first towelette to be dispensed through a rip fence configured as a thimble.

Yet a further aspect of the invention is the provision of a towelette dispenser having a lid with a cap that is configured to push or stuff the leading edge of the next towelette to be dispensed into the container and to prevent it from interfering with the closing and sealing thereof.

Yet a further aspect of the invention is the provision of a towelette dispenser that is of a simplistic design, substantially reducing costs, while significantly increasing ease of use.

The foregoing and other aspects of the invention that will become apparent as the detailed description proceeds are achieved by a towelette dispenser, comprising: a tub having an open end and receiving and maintaining a bulk supply of interconnected towelettes, separable from each other by perforations; a lid received by said tub over said open end, said lid comprising: a base portion having a central aperture; a separation bar bridging said aperture and dividing said aperture into fore and aft sections; a rip fence carried by said separation bar to facilitate the separation of towelettes from each other; and a cap portion received by said lid for closing and sealing said central aperture.

Other aspects of the invention that will become apparent herein are attained by a lid for a towelette dispenser, comprising: a base portion having a central aperture; a separation bar bridging said aperture and dividing said aperture into fore and aft sections; a thimble of flexible gripping fingers carried by said separation bar, said flexible fingers extending over said fore section; and a cap portion carried by said lid for closing and sealing said central aperture.

BRIEF DESCRIPTION OF DRAWING

For a complete understanding of the various aspects, structures and processes of the invention, reference should be made to the following detailed description and accompanying drawing wherein.

BEST MODE FOR CARRYING OUT THE INVENTION

Figure 1:
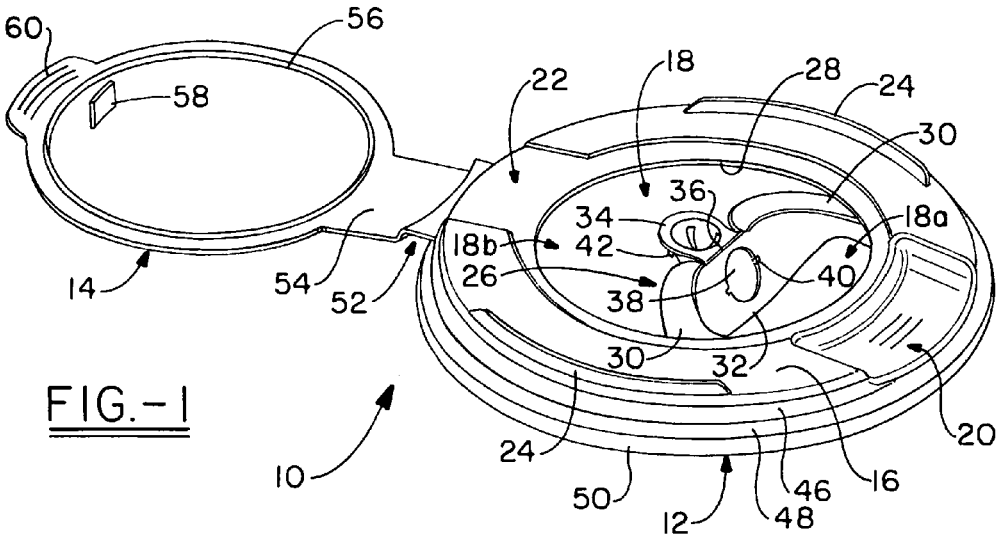
FIG. 1 is a perspective view of a dispensing lid made in accordance with the invention.

Referring now to the drawings, it can be seen that a dispensing lid made in accordance with the invention is designated generally by the numeral 10. As will be appreciated herein, a benefit of the dispensing lid 10 is the fact that it can be molded as a single piece of a suitable plastic or elastomeric material. The dispensing lid 10 includes a base portion 12 and a cap portion 14.

The base portion 12 is characterized by a top annular planar surface 16 having a central aperture 18 therein. About the top periphery of the base portion 12 is a major recessed area 20 to accommodate the user's finger for opening the dispensing lid 10 in a manner to be discussed later herein. Also characterizing the outer peripheral area of the base portion 10 is a minor recessed area 22 adapted to accommodate a portion of the cap 14 when the cap 14 is closed over the aperture 18, in a manner which will become apparent later. A rib or ribs 24 extend upwardly from the top annular planar surface 16 about an outer periphery thereof and are employed to accommodate receipt and stacking of tubs or buckets of the towelettes to be dispensed, in a manner which will be readily appreciated by those skilled in the art.

The base portion 12 includes a separation bar 26 that is connected to and extends inwardly from the inner circumferential edge 28 of the aperture 18. The separation bar 26 includes a pair of legs 30 that extend substantially radially inward to a center support plate 32. The separation bar 26 is positioned to divide the aperture 18 into a smaller fore portion 18*a* and a substantially larger aft portion 18*b*. The purpose and benefits of these distinct and particularly sized portions of the aperture 18 will become apparent herein.

The center support plate 32 carries a rip fence in the form of a thimble 34, of substantially conical shape. The thimble 34 is connected by flexible or "living" hinge 36 to the center support plate 32. As is best shown in FIG. 1, the plate 32 is characterized by the presence of a hole 38 passing therethrough, having slots or notches 40 on diametrically opposed sides thereof. The slots or notches 40 are adapted to receive tabs, latches or the like 42 that are an integral portion of thimble 34. Accordingly, when the thimble 34 is rotated about the hinge 36 such that is passes through the hole 38 of the plate 32, the tabs or latches 42 engage in the slots or notches 40 to securedly maintain the thimble 34 in the position best shown in FIG. 2.

It will be appreciated that the thimble 34 is characterized by a plurality of fingers 44 that are defined by through-slotting of the conical thimble 34. As shown, four or more fingers 44 are desired. Being made of plastic, the fingers 44 are biased inwardly by the conical nature of the thimble 34, but can flex outwardly as needed during use.

As shown in FIG. 1, the base portion 12 is characterized by circumferential flanges 46, 48, separated by a lip 50. The circumferential flange 46 is radiused at its top edge into the top annular planar surface 16. A circumferential lip 50 extends downwardly from and normal to the circumferential flange 48.

With continued reference to FIG. 1, it can be seen that the cap portion 14 is secured by means of an integral hinge, web or member 52 to the base portion 16. Extending from the hinge 52 is a neck 54 that is integral with and connects to the substantially circular portion of the cap 14. An annular ring 56 extends from the cap portion 14 and is sized and configured to be sealingly received by the circumferential edge 28 of the aperture 18 when the lid 14 is pivoted about the hinge 52 when closure is desired.

A stuffer tab or member 58 extends from the cap portion 14 at such a point in location as to be received by the fore aperture portion 18*a* when the cap portion 14 is closed upon the base portion 12. Finally, a lift tab 60 extends from a peripheral edge of the cap portion 14 and is adapted for receipt by the major recess 20 upon closure. The recess 20 allows users to place their fingertips thereunder for lifting engagement with the tab 60. Finally, it will be appreciated that the minor recessed area 22 is positioned and configured to receive the neck portion 54 upon such closure.

Figure 2:
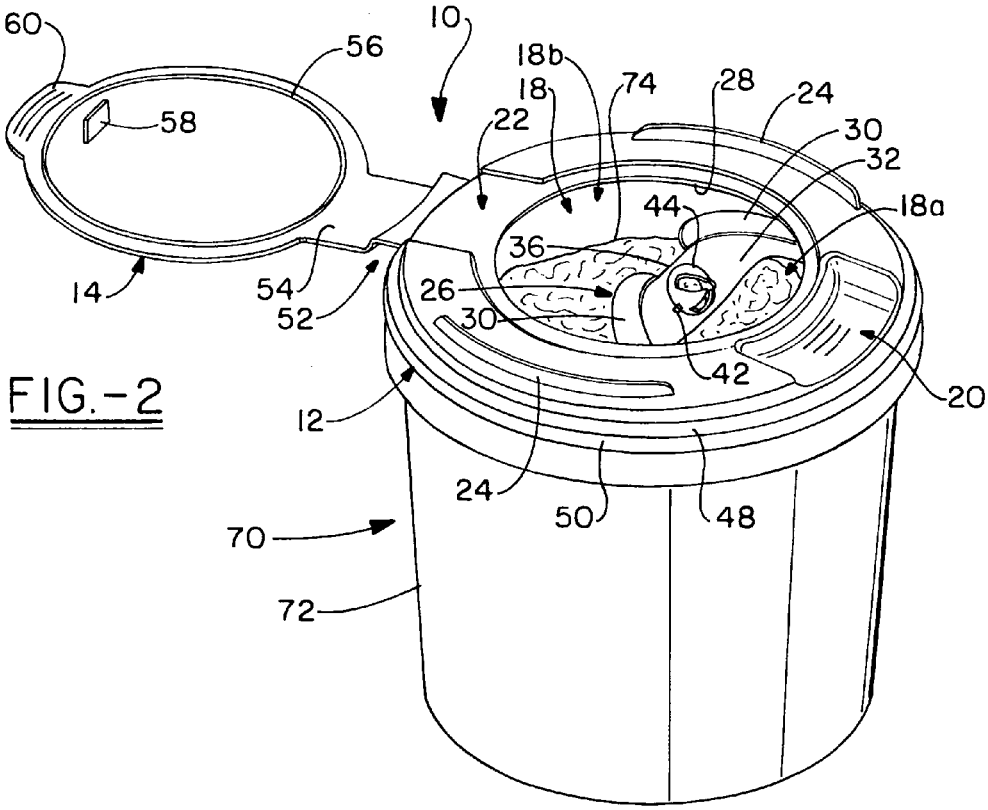
FIG. 2 is a perspective view of a tub of towelettes employing the lid of FIG. 1.

As shown in FIG. 2, a wipes or towelette dispenser employing the cap 10 is designated generally by the numeral 70. A tub or bucket 72 receives the cap 10, with the lip 50 passing over the top outside rim of the tub 72 and with the underside of the circumferential flange 48 resting thereon.

The tub 72 is filled with a plurality of towelettes 74, typically maintained in a roll, but which also may be simply randomly placed therein in bulk. In any event, the invention herein is particularly usable with towelettes that comprise a single web of interconnected towelettes that are defined by perforations therebetween, which are provided for ease of separation.

According to the concept of the invention, the aft portion 18*b* of the aperture 18 is sized sufficiently for the user's hand to reach the lead towelette in the bulk of towelettes 74 maintained therein. When maintained in the roll, the lead towelette comes from the center of the roll. The leading edge of this first to be dispensed towelette may then be threaded through the fingers 44 of the thimble 34. The fingers 44 are sized and configured such as to provide a grip on the towelettes being dispensed, with the grip being sufficient that as the lead towel is pulled through the aperture defined by the fingers, the drag on the towelette is greater than the force required for separation at the perforations connecting the towelettes. In use, as the area of perforation is passed through the thimble 34, the perforations begin to separate as the leading edge of the next towel emerges from the fingers of the thimble 34, such that total separation of the first towelette is achieved when approximately an inch or so of the leading edge of the subsequent towelette has passed through the thimble 34. Accordingly, the leading edge of the next-to-be-dispensed towelette is exposed for ready access by the user.

To ensure that the leading edge of the next towelette does not interfere with sealing of the cap portion 14 over the aperture 18 of the base portion 12, the cap portion 14 is provided with a stuffer tab 58, which is so positioned as to be received by the fore portion 18*a* of the aperture 18 upon closure of the cap 14. This stuffer tab 18 pushes the leading edge of the towelette into the well of the fore portion 18*a* of the aperture 18, and out of the way of any sealing engagement between the cap 14 and base portion 12.

As is apparent from the drawings, the center support plate 32 is angled with respect to the top annular plate surface 16. This angle is for several important reasons. First, by being somewhat vertical, it is much easier for the user to secure the leading edge of the first towelette and thread it through the thimble 34, than if the thimble 34 were substantially vertical. Accordingly, ease of threading of the towel web is attained, without having to remove the dispensing lid 10 from the tub 72.

Additionally, the angle of the thimble 34 allows for ease of withdrawal of the towelette therethrough, while also accommodating an upward pulling motion on the towelette once the perforation has passed through the thimble, if it is not apparent that such separation is proceeding satisfactorily. This upward pulling increases the effective force of at least certain of the teeth or fingers 44 upon the subsequent towelette, and allows for more separating force on the perforations, without further extension of the subsequent towelette through the thimble 34.

While the concept of the invention is adaptable to various sizes of tubs, containers and lids, it is contemplated that the lid 14 will typically have a diameter on the order of 6 inches, with the aperture 18 having a diameter of on the order of 4 inches. However, this sizing can certainly vary as will be appreciated by those skilled in the art. In any event, it is preferred that the separation bar 26 be so positioned that the fore portion 18*a* of the aperture 18 be 15-30% of the total aperture 18, with the remaining aft portion 18*b*, which is preferably sized to accommodate a user's fingers, is on the order of 70-85% of the aperture 18.

It has similarly been found that the thimble 34, which is preferably angled with respect to the horizontal, rather than having a base parallel thereto as was common in the art, be angled upwardly on the order of 15-30° with respect to the horizontal or the top annular planar surface 16. As presented above, this accommodates both threading and separating of the towelettes.

Thus it can be seen that the various aspects of the invention have been satisfied by the structure presented and described herein. While in accordance with the patent statutes only the best known and preferred embodiment of the invention has been presented and described in detail, the invention is not limited thereto or thereby, but is defined by the following claims.

What is claimed is:

1. A towelette dispenser, comprising:

a tub having an open end and receiving and maintaining a bulk supply of interconnected towelettes, separable from each other by perforations;

a lid received by said tub over said open end, said lid comprising:

a base portion having a central aperture;

a separation bar bridging said aperture and dividing said aperture into fore and aft sections;

a rip fence carried by said separation bar to facilitate the separation of towelettes from each other wherein said rip fence comprises a thimble of flexible fingers biased inwardly toward a central axis thereof, said thimble being integral with and hingedly connected to said separation bar; and a cap portion received by said lid for closing and sealing said central aperture.

2. The towelette dispenser according to claim 1, wherein said separation bar is characterized by a hole passing therethrough, said hole receiving said thimble.

3. The towelette dispenser according to claim 2, wherein said thimble is latchedly secured within said hole and to said separation bar.

4. The towelette dispenser according to claim 1, wherein said axis of said thimble is angled upwardly from the horizontal by 15°-30°, when said tub is sitting on a horizontal surface.

5. The towelette dispenser according to claim 4, wherein said fore section of said aperture comprises 15-30% thereof, and said aft section of said aperture comprises 85-70% thereof.

6. The towelette dispenser according to claim 1, wherein said cap portion is hingedly connected to said base portion.

7. The towelette dispenser according to claim 6, wherein said cap portion has a stuffer tab extending therefrom, said stuffer tab positioned to enter said fore portion of said central aperture when said cap portion closes and seals said central aperture.

8. The towelette dispenser according to claim 7, wherein said lid base portions, separation bar, rip fence, and cap portions are integrally formed.

9. A lid for a towelette dispenser, comprising:

a base portion having a central aperture;

a separation bar bridging said aperture and dividing said aperture into fore and aft sections;

a thimble of flexible gripping fingers hingedly connected to said separation bar and securely received within a hole in said separation bar, said flexible fingers extending over said fore section; and a cap portion carried by said lid for closing and sealing said central aperture.

10. The lid for a towelette dispenser according to claim 9, wherein said thimble is secured to said separation bar by a latch.

11. The lid for a towelette dispenser according to claim 10, wherein said thimble is angled upwardly with respect to said base portion at an angle of 15°-30°.

12. The lid for a towelette dispenser according to claim 11, wherein said fore section comprises 15-30% of said central aperture and said aft section comprises 70-85% of said central aperture.

13. The lid for a towelette dispenser according to claim 12, wherein said cap has a stuffer member extending therefrom and positioned to enter said fore section when said cap closes and seals said central aperture.

14. The lid for a towelette dispenser according to claim 13, wherein said cap portion is hingedly connected to said base portion.

15. The lid for a towelette dispenser according to claim 14, wherein said base portion, separation bar, thimble and cap portion are integrally constructed.

* * * * *